US009631803B2

(12) United States Patent
Lim et al.

(10) Patent No.: US 9,631,803 B2
(45) Date of Patent: Apr. 25, 2017

(54) LED LIGHTING APPARATUS WITH HEAT DISSIPATING MEMBER

(71) Applicant: Samsung Electronics Co., Ltd., Suwon-si, Gyeonggi-do (KR)

(72) Inventors: Dong-il Lim, Uijeongbu-si (KR); Sung-jin Kim, Suwon-si (KR); Byung-kwan Song, Bucheon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 68 days.

(21) Appl. No.: 14/490,015

(22) Filed: Sep. 18, 2014

(65) Prior Publication Data

US 2015/0204532 A1 Jul. 23, 2015

(30) Foreign Application Priority Data

Jan. 22, 2014 (KR) ..... 10-2014-0007938

(51) Int. Cl.

| | |
|---|---|
| ***F21V 29/00*** | (2015.01) |
| ***F21V 29/70*** | (2015.01) |
| ***F21V 29/77*** | (2015.01) |
| ***F21K 9/233*** | (2016.01) |
| *F21V 29/56* | (2015.01) |
| *F21V 29/83* | (2015.01) |
| *F21Y 101/00* | (2016.01) |

(52) U.S. Cl.

CPC ..... *F21V 29/70* (2015.01); *F21K 9/233* (2016.08); *F21V 29/773* (2015.01); *F21V 29/83* (2015.01); *F21Y 2101/00* (2013.01)

(58) Field of Classification Search

CPC ..... F21V 29/30; F21V 29/40; F21V 29/56; F21V 29/767; F21V 29/02; F21V 29/65; F21V 29/70–29/717; F21V 29/763; F21K 9/1355; F21K 9/1375; F21K 9/237

See application file for complete search history.

(56) References Cited

U.S. PATENT DOCUMENTS

| | | | | |
|---|---|---|---|---|
| 7,040,388 | B1 * | 5/2006 | Sato | F28F 3/04 165/121 |
| 2004/0244947 | A1 * | 12/2004 | Chen | F28F 3/04 165/80.3 |
| 2007/0132092 | A1 | 6/2007 | Hu et al. | |
| 2010/0039013 | A1 * | 2/2010 | Tsai | F21V 29/004 313/46 |
| 2010/0079075 | A1 * | 4/2010 | Son | F21K 9/17 315/152 |

(Continued)

FOREIGN PATENT DOCUMENTS

| | | |
|---|---|---|
| EP | 2175196 | 4/2010 |
| JP | 2012-119283 | 6/2012 |

OTHER PUBLICATIONS

Extended European Search Report dated Jun. 9, 2015 from European Patent Application No. 14200181.7, 8 pages.

*Primary Examiner* — Anh Mai
*Assistant Examiner* — Steven Horikoshi
(74) *Attorney, Agent, or Firm* — Staas & Halsey LLP

(57) ABSTRACT

A light-emitting diode (LED) lighting apparatus includes an exterior member which covers a heat-dissipating member. Therefore, the LED lighting apparatus may be dustproof and waterproof. The shape of the heat-dissipating member may be modified to increase the surface area thereof and thus effectively dissipate heat.

17 Claims, 9 Drawing Sheets

(56) References Cited

U.S. PATENT DOCUMENTS

| | | | | |
|---|---|---|---|---|
| 2010/0096992 | A1* | 4/2010 | Yamamoto | F21K 9/1355 315/112 |
| 2010/0187963 | A1* | 7/2010 | Vaccaro | F21V 29/004 313/46 |
| 2010/0277067 | A1* | 11/2010 | Maxik | F21V 3/00 315/32 |
| 2012/0025687 | A1* | 2/2012 | Wen | F21V 29/75 313/46 |
| 2012/0106174 | A1 | 5/2012 | Chuang et al. | |
| 2012/0161630 | A1* | 6/2012 | Miki | F21V 29/004 315/51 |
| 2013/0039071 | A1* | 2/2013 | Wang | F21V 3/00 362/294 |

* cited by examiner

LED LIGHTING APPARATUS WITH HEAT DISSIPATING MEMBER

CROSS-REFERENCE TO RELATED APPLICATIONS

This application claims the benefit of Korean Patent Application No. 10-2014-0007938, filed on Jan. 22, 2014, in the Korean Intellectual Property Office, the disclosure of which is incorporated herein in its entirety by reference.

BACKGROUND

1. Field

One or more embodiments of the disclosure relate to a light emitting diode (LED) lighting apparatus including a heat-dissipating member, and more particularly, to an LED lighting apparatus including a heat-dissipating member accommodated in an exterior member.

2. Description of the Related Art

Light-emitting diodes (LEDs) are semiconductor devices capable of emitting light by the electroluminescence phenomenon when a forward voltage is applied thereto. The emission wavelength of LEDs may be determined by semiconductor crystal materials and concentrations thereof. For example, LEDs may generate ultraviolet rays, visible rays, or infrared rays.

LED lighting apparatuses consume low power and have fast responses, as compared with other lighting apparatuses such as fluorescent lamps, halogen lamps, and incandescent lamps. In addition, LEDs are eco-friendly and efficient. Therefore, much research has been conducted to commercialize LED lighting apparatuses.

However, if heat is not effectively dissipated from LEDs, the lifespan and performance of the LEDs may be markedly decreased, and thus, heat-dissipating structures or methods may be necessary, particularly for high-power LEDs emitting a large amount of heat.

In the related art, heat-dissipating members are exposed to the outside of lighting apparatuses to dissipate heat through direct contact with ambient air. However, if heat-dissipating members are exposed to the outside for a long time, surfaces of the heat-dissipating members may be covered with contaminants such as dust, and thus, the heat-dissipating ability of the heat-dissipating members may be lowered due to the contaminants. Thus, outdoor LED lighting apparatuses may have a short lifespan and low brightness in spite of the semi-permanent characteristics of LEDs. Furthermore, exposed heat-dissipating members may decrease the degree of design freedom of LED lighting apparatuses and may make it difficult to provide effective waterproofing.

SUMMARY

One or more embodiments of the disclosure include a light-emitting diode (LED) lighting apparatus having increased degrees of design freedom.

One or more embodiments of the disclosure include a waterproof and dustproof LED lighting apparatus.

Additional aspects will be set forth in part in the description which follows and, in part, will be apparent from the description, or may be learned by practice of the presented embodiments.

According to one or more embodiments of the disclosure, an LED lighting apparatus may include an LED board on which an LED module is disposed, a heat-dissipating member, an exterior member, and a cover unit. The heat-dissipating member may include a mount on which the LED board is disposed, a core connected to the mount, and a heat-dissipating part. The heat-dissipating part may include a plurality of concave and convex portions repeatedly arranged around the core in radial directions of the core and extending in a length direction of the core. The exterior member may include a cylindrical main body inserted in the core and an outer part extending from an upper edge of the main body to accommodate the concave and convex portions therein, a side of the outer part being opened. The cover unit may be coupled to the side of the outer part of the exterior member.

The outer part may include a first surface facing the concave and convex portions of the heat-dissipating part, and a second surface facing an outer side, wherein concave and convex portions may be repeatedly formed on the first surface of the outer part.

The outer part may include a first surface facing the concave and convex portions, and a second surface facing an outer side, wherein bosses may be repeatedly formed on the first surface of the outer part.

The concave and convex portions of the heat-dissipating part may include a first peripheral portion, a second peripheral portion, and a connection portion connecting the first and second peripheral portions, and the first and second peripheral portions may extend in a circumferential direction of the core, wherein concave and convex portions may be repeatedly formed on at least one surface of the first and second peripheral portions.

The LED lighting apparatus may further include a material or medium having a greater conductivity than that of air which is disposed between the heat-dissipating member and the exterior member.

The heat-dissipating member and the exterior member may be formed of aluminum, copper, and/or tungsten.

According to one or more embodiments of the disclosure, an LED lighting apparatus may include an LED board on which an LED module is disposed, a heat-dissipating member, an exterior member, and a cover unit. The heat-dissipating member may include a mount on which the LED board is disposed, a core connected to the mount, and a plurality of heat-dissipating fins. For example, the plurality of heat-dissipating fins may be ring-shaped heat-dissipating fins extending in a circumferential direction of the core, the heat-dissipating fins being spaced apart from each other in a length direction of the core. For example, the plurality of heat-dissipating fins may extend in a lengthwise direction of the core, the heat-dissipating fins being spaced apart from each other in a circumferential direction of the core. The exterior member may include a cylindrical main body inserted in the core and an outer part extending from an upper edge of the main body to accommodate the heat-dissipating fins therein, a side of the outer part being opened. The cover unit may be coupled to the side of the outer part of the exterior member.

The outer part may include a first surface facing the heat-dissipating fins, and a second surface facing an outer side, wherein concave and convex portions may be repeatedly formed on the first surface of the outer part.

The outer part may include a first surface facing the heat-dissipating fins, and a second surface facing an outer side, wherein bosses may be repeatedly formed on the first surface of the outer part.

Each of the heat-dissipating fins may include a first surface and a second surface opposite to the first surface, wherein concave and convex portions may be repeatedly formed on at least one of the first and second surfaces.

The heat-dissipating fins may have a rectangular plate shape.

According to one or more embodiments of the disclosure, an LED lighting apparatus may include an LED board on which an LED module is disposed, a heat-dissipating member, an exterior member, and a cover unit. The heat-dissipating member may include a mount on which the LED board is disposed, a core connected to the mount, and a heat-dissipating part extending from an upper circumference of the core. The cover unit may be disposed at a lower side of the exterior member to cover the LED module. The exterior member may include a cylindrical main body inserted in the core and an outer part extending from an upper edge of the main body to accommodate the heat-dissipating part therein, a side of the outer part being opened.

A plurality of first penetration holes may be arranged along a circumference of the cover unit, a plurality of second penetration holes may be arranged along an outermost portion of the heat-dissipating part, and a plurality of third penetration holes may be arranged along an upper circumference of the exterior member.

The cover unit and the heat-dissipating member may be coupled to each other so that the first penetration holes communicate with the second penetration holes, and ambient air introduced through the first penetration holes flows through the second penetration holes into a space formed between a peripheral portion of the heat-dissipating member and a first surface of the exterior member, and then is discharged through the third penetration holes.

Concave and convex portions may be repeatedly formed in a lengthwise direction of the heat-dissipating part.

The outer part may include a first surface facing the heat-dissipating member, and a second surface facing an outer side, wherein concave and convex portions may be repeatedly formed on the first surface of the outer part.

As described above, since the LED lighting apparatus includes the heat-dissipating member and the exterior member, the LED lighting apparatus may have improved heat dissipation efficiency. In addition, since the heat-dissipating member is not exposed to the outside, the LED lighting apparatus may have an increased degree of design freedom and may be dustproof and waterproof.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
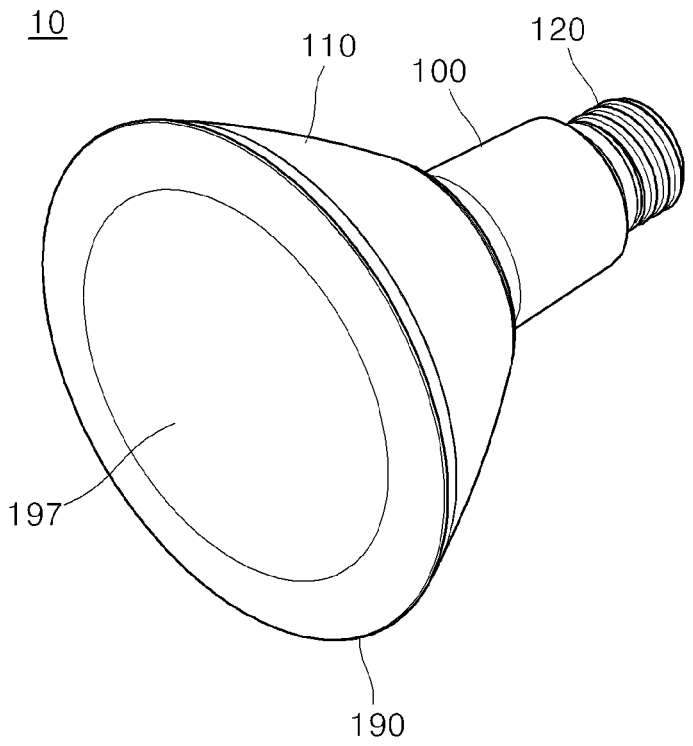
FIG. 1 is a perspective view illustrating a light-emitting diode (LED) lighting apparatus according to an embodiment of the disclosure.

Reference will now be made in detail to embodiments, examples of which are illustrated in the accompanying drawings, wherein like reference numerals refer to like elements throughout. In this regard, the embodiments disclosed herein may have different forms and should not be construed as being limited to the descriptions set forth herein. Accordingly, the embodiments are merely described below, by referring to the figures, to explain aspects of the embodiments. As used herein, the term "and/or" includes any and all combinations of one or more of the associated listed items. Expressions such as "at least one of," when preceding a list of elements, modify the entire list of elements and do not modify the individual elements of the list. In the drawings, elements not relating to descriptions are not shown for clarity, and the sizes of elements such as widths, lengths, and heights may be exaggerated for clarity.

Figure 2:
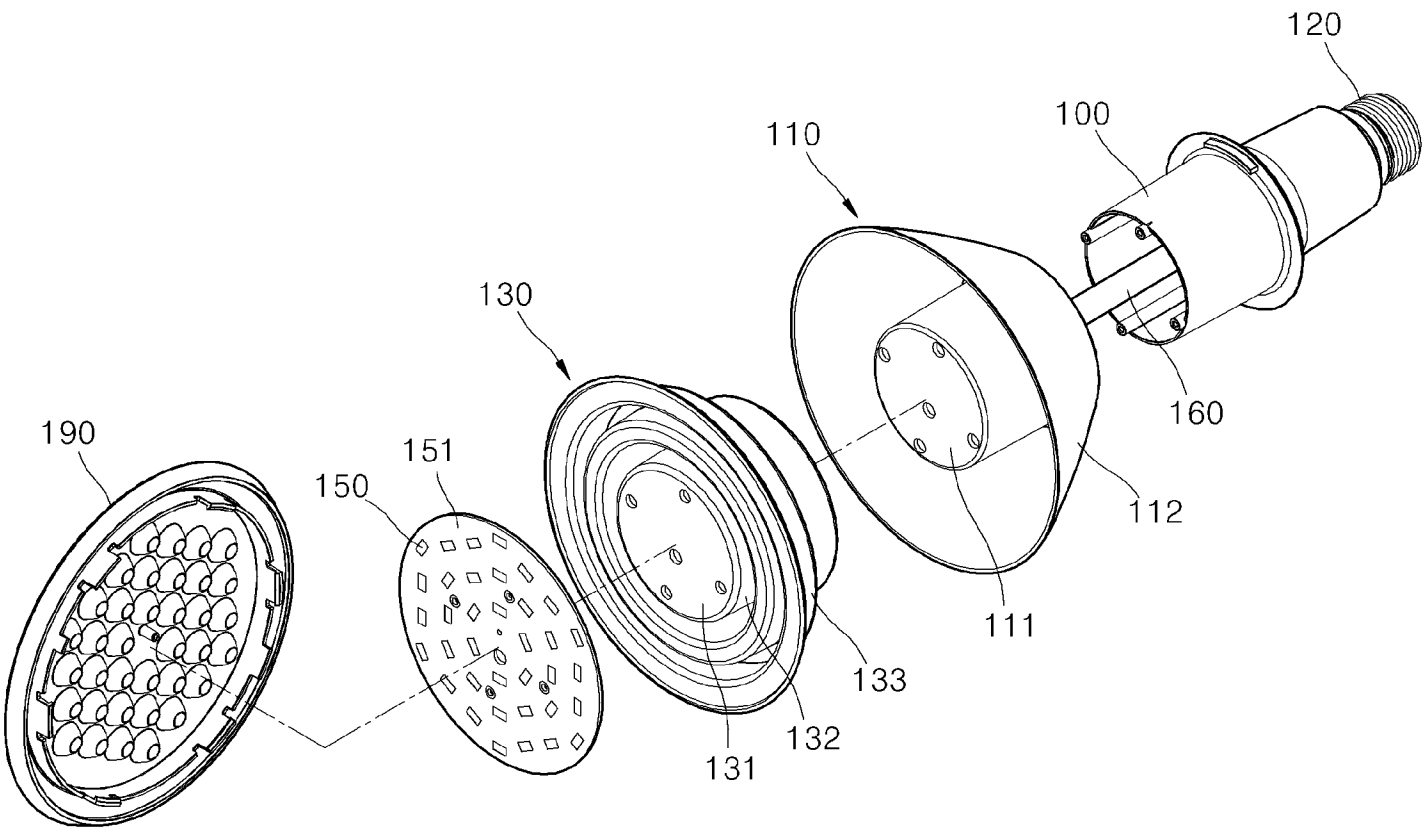
FIG. 2 is an exploded perspective view illustrating the LED lighting apparatus according to an embodiment of the disclosure.

FIG. 1 is a perspective view illustrating a light-emitting diode (LED) lighting apparatus 10 according to an embodiment of the disclosure, and FIG. 2 is an exploded perspective view illustrating the LED lighting apparatus 10 according to an embodiment of the disclosure.

Referring to FIGS. 1 and 2, the LED lighting apparatus 10 may include a housing 100, an exterior member 110, a heat-dissipating member 130, LED modules 150, a socket 120, a cover unit 190, and a cover portion 197.

The housing 100 may have a cylindrical shape with a first end and a second end, which are both opened. The socket 120 may be coupled to an end of the housing 100. For example, the first end of the housing 100 may correspond to the end closest to the socket 120, while the second end of the housing 100 may correspond to the end furthest from the socket 120. The second end of the housing 100 may be adjacent to, and connected to, exterior member 110. For example, the housing 100 may be disposed in a main body 111 of the exterior member 110, and a connection member 160 may be disposed in the housing 100. The main body 111 may have a cylindrical shape, however the disclosure is not limited to this shape and the main body may be shaped in a rectangular, square, or other geometric manner.

The exterior member 110 may include the main body 111 having the cylindrical shape and an outer part 112 configured to cover the heat-dissipating member 130. The housing 100 and the connection member 160, which is configured to connect a printed circuit board to the socket 120, may be disposed in the cylindrical main body 111. The heat-dissipating member 130 may be disposed in the outer part 112 of the exterior member 110. That is, the heat-dissipating member 130 may be shaped such that a core 132 fits over main body 111, and the heat-dissipating member 130 resides or is disposed within the surrounding recess or interior space of the exterior member 110 about the main body 111. For example, the main body 111 may have a cylindrical shape having a first end which is closed and an opposite second end which is opened. The closed first end may be inserted into an opened end of the core 132. Therefore, the heat-dissipating member 130 may not be seen from the outside and may be protected from dust and moisture. In addition, since the LED lighting apparatus 10 includes the exterior member 110, the degree of design freedom of the LED lighting apparatus 10 may be increased by freely selecting the outer surface shape of the outer part 112. For example, the outer surface shape of the outer part 112 as shown in FIG. 2 is shape in a conical fashion, resembling a lampshade, or more particularly, a truncated cone or the frustum of a cone. However, the disclosure is not limited to this example surface shape of the outer part 112, which may take other shapes. For example, the surface shape of the outer part 112 may be spherical, rectangular, triangular, or shaped in other polygonal or geometric shapes, which may or may not be symmetric, irregular, or truncated. Generally, the outer part 112 may have any other shape capable of accommodating the heat-dissipating part 133.

The LED modules 150 may be coupled to an LED board 151, on which the printed circuit board is mounted, and in this state, the LED modules 150 may be disposed on an end of the exterior member 110. The LED modules 150 may be manufactured by mounting LEDs on a package substrate and packaging the LEDs. The LED board 151, on which the LED modules 150 are mounted, may be mounted on a mount 131 of the heat-dissipating member 130 by using additional fastening members. The LED modules 150 may be arranged on the LED board 151 in any number of ways or patterns. Generally, the LED modules 150 may be arranged on the LED board 151 according to a desired output or performance of the LED modules 150.

As shown in FIGS. 1 and 2, the socket 120 may be coupled to an end of the housing 100 and may be electrically connected to the printed circuit board (not shown) mounted on the LED board 151 through the connection member 160 disposed in the housing 100. For example, the socket 120 may have an Edison type structure or a swan type structure.

The cover unit 190 may be coupled to the exterior member 110 to cover the LED modules 150. A cover portion 197 of the cover unit 190 protects the LED modules 150 and transmits light emitted from the LED modules 150. For example, the cover portion 197 may have a semispherical (e.g., lens) shape or a plate (e.g., planar) shape having a predetermined thickness. However, the disclosure is not limited to these example shapes of the cover portion 197. Generally, the cover portion 197 is shaped in a similar manner as the cover unit 190, which may also take various forms or shapes. That is, a shape of the cover unit 190 may correspond to the surface shape of outer part 112 of the exterior member 110. The cover unit 190 may coupled to the exterior member 110 using various fastening devices or locking or sealing mechanisms (e.g., screws, clips, via an O-ring, etc.).

The heat-dissipating member 130 may include the mount 131 coupled to the LED board 151, a core 132 having a barrel shape such as a cylindrical shape having an opened end and an opposite closed end, and a heat-dissipating part 133 connected to the core 132. As shown in FIG. 2, for example, the core 132 may have an opened end which is adjacent to an end of main body 111, and a closed end which is adjacent to mount 131 and LED board 151. Heat generated while the LED modules 150 are powered may be sequentially transferred to the LED board 151, the mount 131, the core 132, and the heat-dissipating part 133. A medium 200 (refer to FIG. 3) may be disposed between the heat-dissipating part 133 and the exterior member 110, and heat may be transferred from the heat-dissipating part 133 to the exterior member 110 through the medium 200. Therefore, as the contact area between the medium 200 and the heat-dissipating part 133 and/or the exterior member 110 is increased, the rate of heat transfer from the heat-dissipating part 133 to the exterior member 110 may be increased. That is, since the rate of heat conduction between media increases as the contact area between the media increases, the efficiency of heat dissipation may be increased by increasing the contact area between the medium 200 and the heat-dissipating part 133 and/or the exterior member 110.

The structures of the heat-dissipating member 130 and the exterior member 110 will be described below in more detail with reference to FIGS. 3 to 7.

Figure 3:
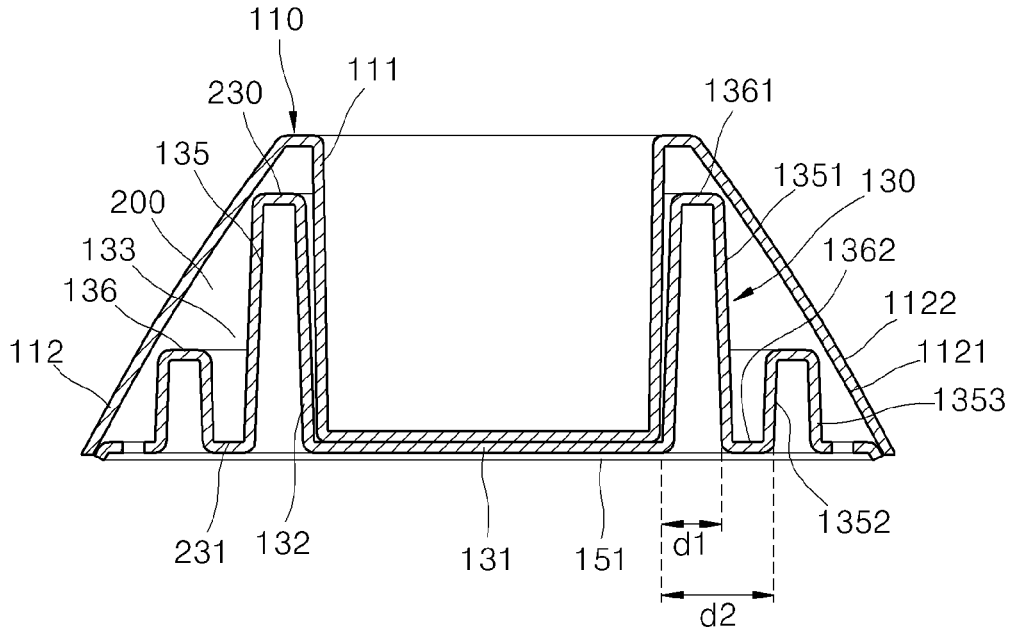
FIG. 3 is a cross-sectional view illustrating a heat-dissipating member and an exterior member according to an embodiment of the disclosure.

FIG. 3 is a cross-sectional view illustrating the heat-dissipating member 130 and the exterior member 110 according to an embodiment of the disclosure.

The heat-dissipating member 130 may be formed of a material having a high thermal conductivity such as aluminum. As shown in FIGS. 3 and 4A to 4C, the heat-dissipating member 130 may include the mount 131, the core 132, and the heat-dissipating part 133. The mount 131 may have a plate shape and be formed on a lower side of the heat-dissipating member 130 for coupling with the LED board 151. Here, in describing the physical arrangement of the exterior member 110 with respect to FIG. 3, the "lower side" may refer to a side of the heat-dissipating member 130 which is closer to the LED board 151, while the "upper side" may refer to a side of the heat-dissipating member 130 which is closer to the housing 100 or socket 120. The core 132 may have a cylindrical shape with a first end which is closed, and a second end which is open, or alternatively the core 132 may have a first end and a second end, which are both opened. For example, an end of the core 132 (e.g., a first end) may be connected to the mount 131. For example, an end of the core 132 (e.g., a second end) may be connected to the main body 111 of the exterior member 110.

The heat-dissipating part 133 may include a plurality of peripheral portions 135 having a first end and a second end which are both opened, and ring-shaped connection portions 136 connecting upper or lower edges of the peripheral portions 135. The peripheral portions 135 may be arranged at preset intervals away from the core 132. For example, the peripheral portions 135 may include a first peripheral portion 1351 closest to the core 132 and spaced a first distance d1 from the core 132, and a second peripheral portion 1352 that is second (or next) closest to the core 132 and spaced a second distance d2 from the core 132. For example, the peripheral portions 135 may further include a third peripheral portion 1353 which is furthest from the core 132 compared to the first peripheral portion 1351 and the second peripheral portion 1352. The third peripheral portion 1353 may be spaced apart from the core by a third distance.

The connection portions 136 may include a first connection portion 1361 disposed between upper edges of the core 132 and the first peripheral portions 1351 to connect the core 132 and the first peripheral portions 1351, and a second connection portion 1362 disposed between lower edges of the first and second peripheral portion 1351 and 1352 to connect the first and second peripheral portions 1351 and 1352. For example, the connection portions 136 may further include a third connection portion which is disposed between upper edges of the second peripheral portion 1352 and third peripheral portion 1353 to connect the second and third peripheral portions 1352 and 1353. Therefore, as shown in FIG. 3, concave portions 231 and convex portions 230 may be formed on the cross-section of the heat-dissipating part 133. That is, the concave portions 231 and the convex portions 230 may be repeatedly arranged in radial directions of the core 132 and may extend in the length direction of the core 132 by repeatedly arranging the peripheral portions 135 and connecting neighboring pairs of the peripheral portions 135 using the connection portions 136. Since the concave portions 231 and the convex portions 230 are formed on the heat-dissipating part 133, the heat-dissipating part 133 may have a large surface area. Therefore, the contact area between the heat-dissipating part 133 and the medium 200 filled between the heat-dissipating member 130 and the exterior member 110 may be increased, and thus, heat may be efficiently transferred from the heat-dissipating member 130 to the medium 200.

The medium 200 may correspond to an intermediate material for transferring heat from the heat-dissipating member 130 to the exterior member 110. A gaseous material may be used as the medium 200. The LED lighting apparatus 10 shown in FIGS. 1 to 6B according to embodiments of the disclosure may be airtight, and thus ambient air may not permeate into the LED lighting apparatus 10. A gas having a higher thermal conductivity than that of air may be filled between the heat-dissipating member 130 and the exterior member 110 to effectively transfer heat.

The exterior member 110 may correspond to a shield which protects the heat-dissipating member 130 from surrounding environments. Owing to the heat-dissipating member 130, the heat-dissipating member 130 may not be seen from the outside of the LED lighting apparatus 10 and may be protected from dust and moisture. The exterior member 110 may include the main body 111 and the outer part 112. The main body 111 may have a cylindrical shape having a first end which is closed and an opposite second end which is opened. The main body 111 may be insertable into the core 132. The outer part 112 may be used to cover the heat-dissipating member 130. The outer part 112 may have a truncated cone shape with both end edges thereof being connected to an upper edge of the main body 111 and the circumference (i.e., circumferential outer portion) of the cover unit 190. An accommodation space may be formed in the outer part 112 to accommodate the heat-dissipating part 133. However, as noted previously, the shape of the outer part 112 is not limited to the truncated cone shape. That is, the outer part 112 may have any other shape capable of accommodating the heat-dissipating part 133. The exterior member 110 may have a first surface 1121 which makes contact with the medium 200 and a second surface 1122 making contact with ambient air, and thus, heat may be transferred to the outside of the exterior member 110. That is, the first surface 1121 may correspond to an internal or interior surface of the outer part 112, while the second surface 1122 may correspond to an external or exterior surface of the outer part 112. To this end, the exterior member 110 may be formed of a material having a high thermal conductivity such as aluminum, copper, and tungsten. The cover unit 190 may be coupled to a lower side of the outer part 112 of the exterior member 110 with an O-ring (not shown) being disposed along the edge of an opened end of the outer part 112 of the exterior member 110, so as to close the inner space of the exterior member 110. In this way, the inner side of the exterior member 110 may be protected from dust and moisture. As noted previously, the cover unit 190 may be coupled to the outer part 112 of the exterior member 110 by other methods (e.g., a fastener such as a screw or clip), and the disclosure is not limited to coupling the cover unit 190 to the outer part 112 of the exterior member 110 via an O-ring.

Figure 4A:
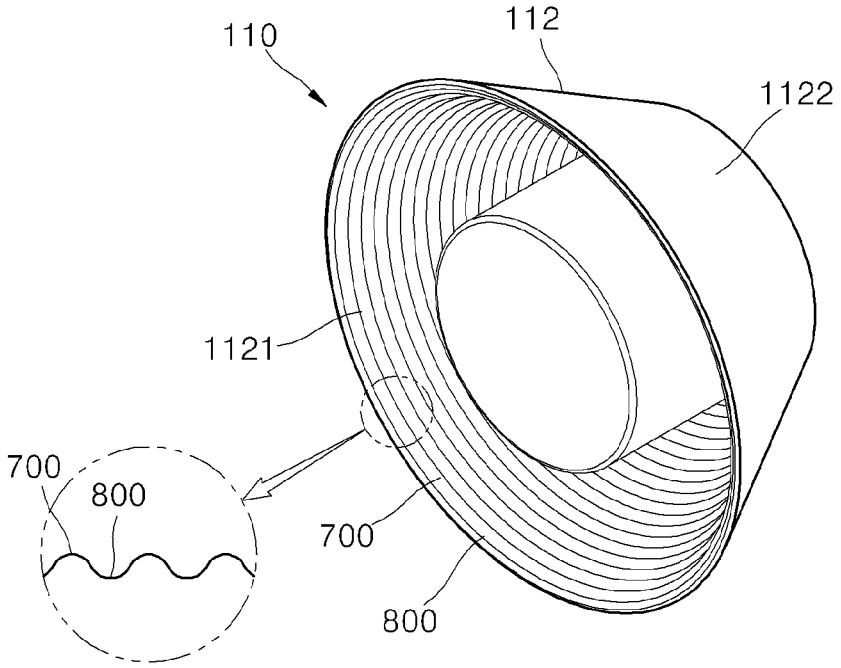
FIGS. 4A and 4B are perspective views illustrating modification examples of the exterior member.
Figure 4B:
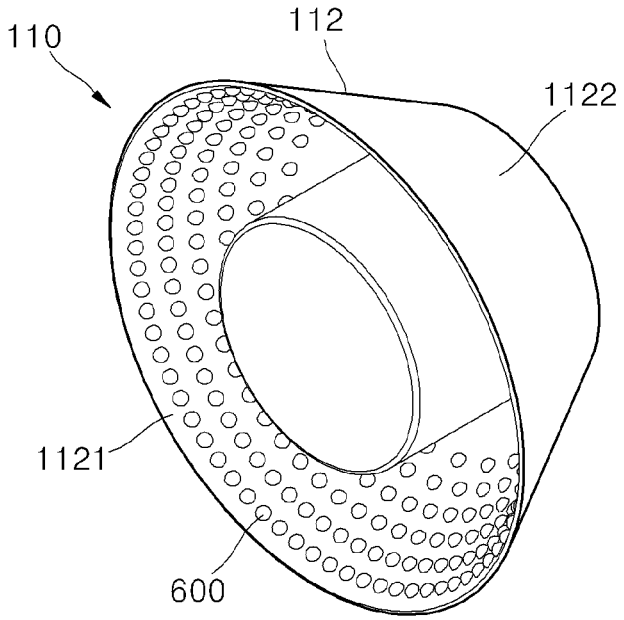
Figure 4C:
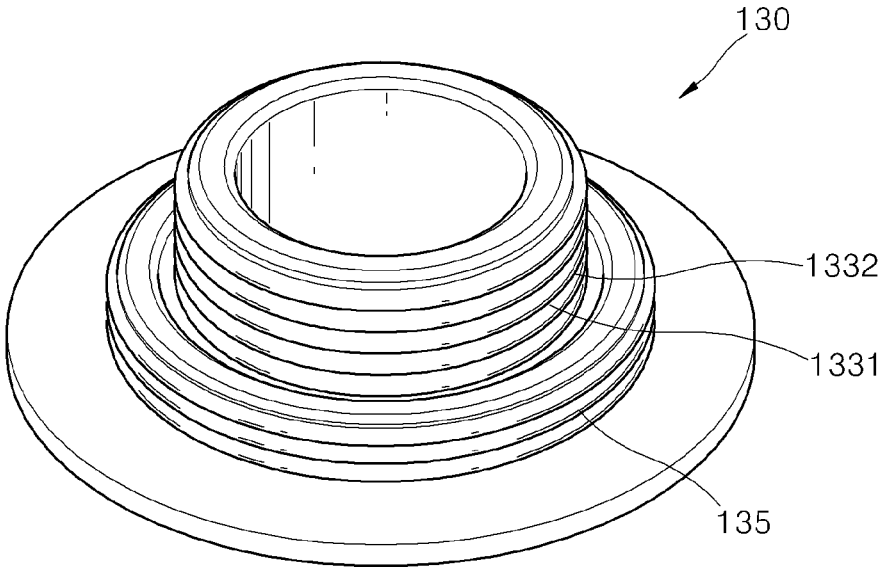
FIG. 4C is a perspective view illustrating a modification example of the heat-dissipating member.

FIGS. 4A and 4B are perspective views illustrating modification examples of the exterior member 110. FIG. 4C is a perspective view illustrating a modification example of the heat-dissipating member 130.

Heat may be transferred from the heat-dissipating member 130 to the outside by conduction, and thus, the effect of heat dissipation may be increased as the contact areas among the medium 200, the heat-dissipating part 133, and the exterior member 110 are increased. Hereinafter, methods of increasing the surface areas of the heat-dissipating part 133 and the exterior member 110 making contact with the medium 200 will be explained with reference to FIGS. 4A to 4C.

Referring to FIGS. 4A and 4B, the outer part 112 of the exterior member 110 has a first surface 1121 making contact with the medium 200 and a second surface 1122 making contact with ambient air. A user may see the second surface 1122 of the outer part 112 from the outside of the exterior member 110. The second surface 1122 may be formed, for example, as an aesthetically-pleasing, dustproof, and waterproof surface. For example, the second surface 1122 may be sleekly formed to improve the aesthetic appearance of the LED lighting apparatus 10 and prevent contaminants such as dust from accumulating thereon. Thus, a progressive decrease in the efficiency of heat dissipation caused by contaminants may be reduced.

Concave portions 800 and convex portions 700 may be formed in the circumferential direction of the first surface 1121 to increase the rate of heat conduction. If the first surface 1121 of FIG. 4A, on which the concave portions 800 and the convex portions 700 are formed, is compared with the first surface 1121 shown in FIG. 3, the first surface 1121 shown in FIG. 4A may have a larger surface area than the first surface 1121 shown in FIG. 3 owing to the concave portions 800 and the convex portions 700. That is, the first surface 1121 of FIG. 4A may have a larger specific surface area than the first surface 1121 of FIG. 3. Thus, the contact area between the medium 200 and the first surface 1121 may be increased to increase the rate of heat conduction from the medium 200 to the exterior member 110.

Referring to FIG. 4B, bosses 600 are repeatedly formed on the first surface 1121 of the outer part 112. If the first surface 1121 of FIG. 4B, on which the bosses 600 are formed, as shown in FIG. 4B, is compared with the first surface 1121 of FIG. 3, on which no bosses are formed, the first surface 1121 shown in FIG. 4B may have a larger surface area than the first surface 1121 shown in FIG. 3. Thus, the contact area between the medium 200 and the first surface 1121 may be increased to increase the rate of heat conduction.

This may also be applied to the surface of the heat-dissipating part 133 making contact with the medium 200. Referring to FIG. 4C, concave portions 1331 and convex portions 1332 are repeatedly formed on the first to third peripheral portions 1351, 1352, and 1353 of the peripheral portions 135 of the heat-dissipating part 133 in the circumferential directions thereof. If the peripheral portions 135 of FIG. 4C, on which the concave portions 1331 and the convex portions 1332 are formed, are compared with the peripheral portions 135 of FIG. 3, on which the concave portions 1331 and the convex portions 1332 are not formed, the peripheral portions 135 shown in FIG. 4C may have a larger surface area than the peripheral portions 135 shown in FIG. 3 owing to the concave portions 1331 and the convex portions 1332. That is, the peripheral portions 135 shown in FIG. 4C may have a larger specific surface area than the peripheral portions 135 shown in FIG. 3. Thus, the contact area between the medium 200 and the peripheral portions 135 may be increased, and thus, the rate of heat conduction from the heat-dissipating part 133 to the medium 200 may be increased. In this way, the rate of heat conduction from the heat-dissipating part 133 to the medium 200 and the rate of heat conduction from the medium 200 to the exterior member 110 may be increased to increase the efficiency of heat dissipation of the LED lighting apparatus 10.

Figure 5A:
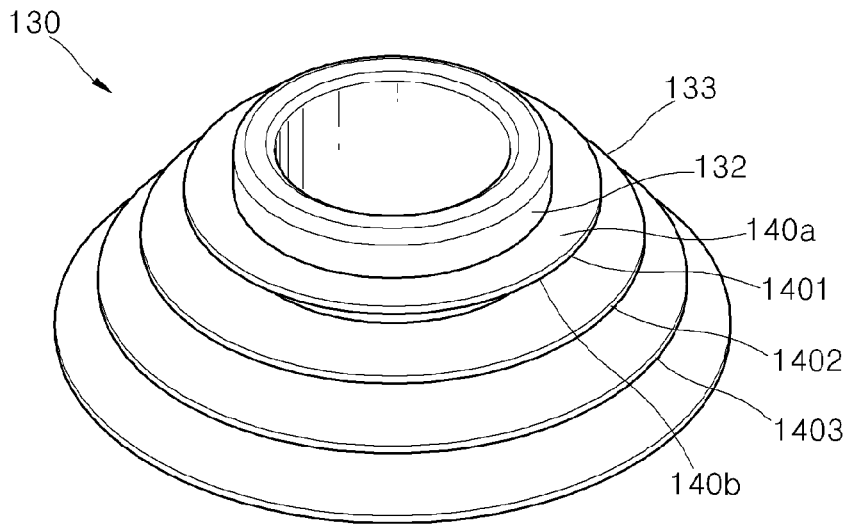
FIG. 5A is a perspective view illustrating a heat-dissipating member according to an embodiment of the disclosure.

FIG. 5A is a perspective view illustrating a heat-dissipating member 130 according to another embodiment of the disclosure.

Referring to FIGS. 3 and 5A, a heat-dissipating part 133 may include a plurality of heat-dissipating fins 140. For example, first, second, and third heat-dissipating fins 1401, 1402, and 1403 may be arranged in the length direction of a core 132 and may be connected to the core 132. For example, the first, second, and third heat-dissipating fins 1401, 1402, and 1403 may be formed to have a ring or disc shape, with the same or varying diameters. The heat-dissipating fins 1401, 1402, and 1403 may be arranged at regular or irregular intervals along the length direction of the core 132. The heat-dissipating fins 1401, 1402, and 1403 may extend the full length of the core 132, or only partially. The first, second, and third heat-dissipating fins 1401, 1402, and 1403 of the heat-dissipating part 133 may be arranged in parallel with each other and connected to the core 132. Then, both surfaces 140*a* and 140*b* of the first, second, and third heat-dissipating fins 1401, 1402, and 1403 may be opened. In other words, the heat-dissipating fins 140 of the heat-dissipating part 133 may make contact with the medium 200 through first and second surfaces 140*a* and 140*b* of the heat-dissipating fins 140, and thus, the contact area therebetween may be increased to increase the rate of heat conduction by the heat-dissipating member 130. The disclosure is not limited to the example heat-dissipating part 133 shown in FIG. 5A. That is, the heat-dissipating part 133 may include a plurality of heat-dissipating fins 140 (for example, two heat-dissipating fins, three heat-dissipating fins, or more than three heat-dissipating fins).

Figure 6A:
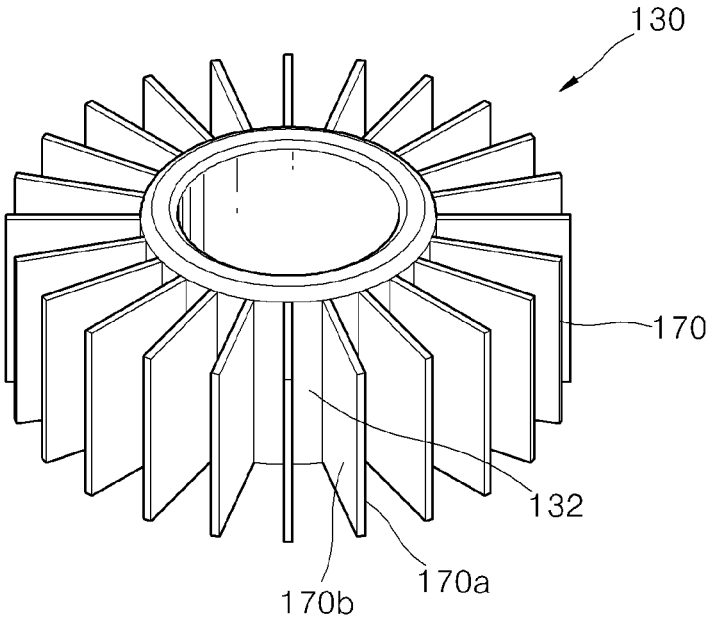
FIG. 6A is a perspective view illustrating a heat-dissipating member according to an embodiment of the disclosure.

FIG. 6A is a perspective view illustrating a heat-dissipating member 130 according to another embodiment of the disclosure.

Referring to FIGS. 3 and 6A, a heat-dissipating part 133 may include a plurality of heat-dissipating fins 170 having a rectangular plate shape and extending in the length direction of a core 132. The shape of the heat-dissipating fins 170 is not limited to a rectangular shape. That is, the heat-dissipating fins 170 may have any other shape as long as the heat-dissipating fins 170 may be disposed in the exterior member 110 and extend in the length direction of the core 132. The heat-dissipating fins 170 may be arranged at regular or irregular intervals along the circumferential direction of the core 132. The heat-dissipating fins 170 may extend the full length of the core 132, or only partially. For example, both first and second surfaces 170*a* and 170*b* of the heat-dissipating fins 170 may be opened and thus may make contact with the medium 200. Therefore, the contact area between the heat-dissipating part 133 and the medium 200 may be increased, and thus, the rate of heat conduction by the heat-dissipating member 130 may be increased.

Figure 5B:
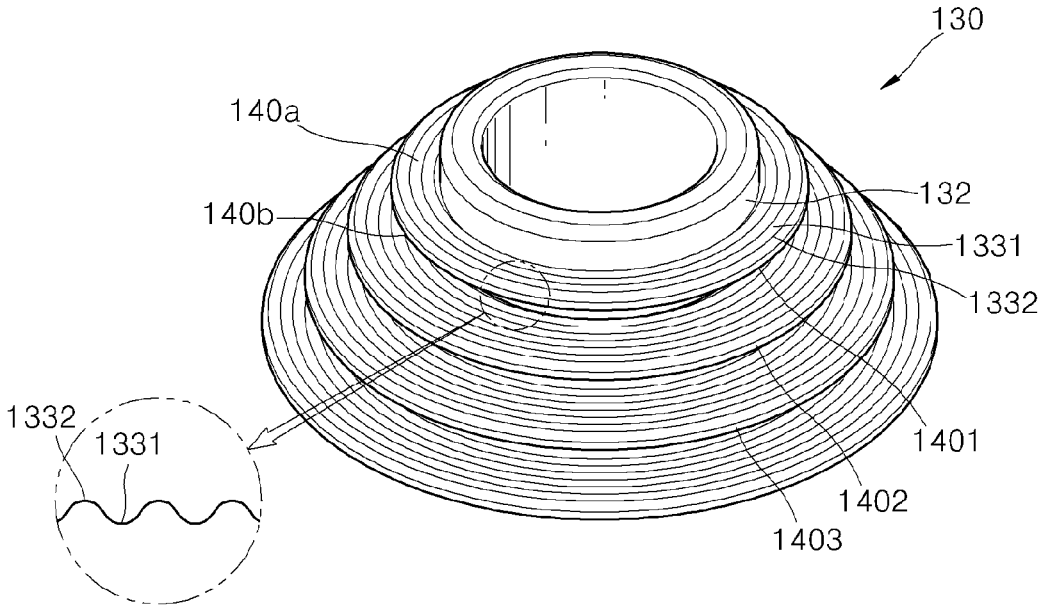
FIG. 5B is a perspective view illustrating a modification example of heat-dissipating fins.
Figure 6B:
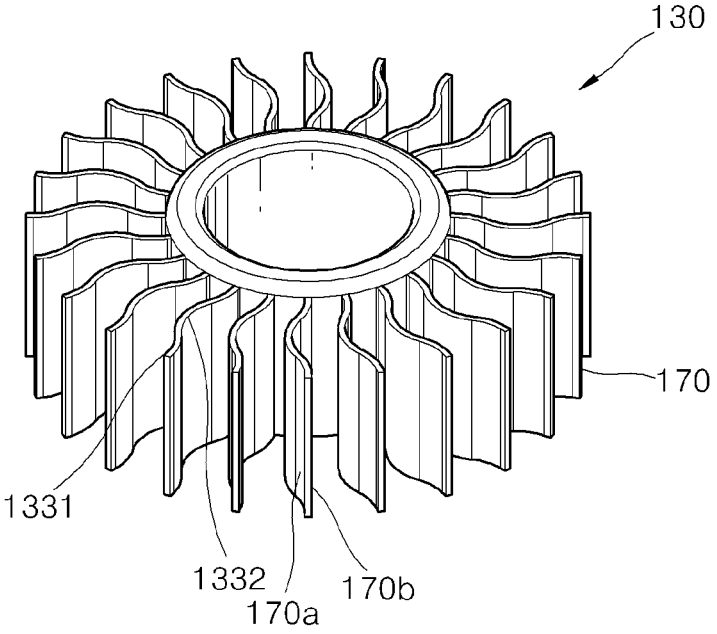
FIG. 6B is a perspective view illustrating a modification example of heat-dissipating fins.

FIGS. 5B and 6B illustrate modified examples of the heat-dissipating member 130 of the LED lighting apparatus 10 of the embodiments shown in FIGS. 5A and 6A.

As described above, heat may be transferred from the heat-dissipating member 130 to the outside by conduction, and thus, the effect of heat dissipation may be increased as the contact areas among the medium 200, the heat-dissipating part 133, and the exterior member 110 are increased. Hereinafter, methods of increasing the surface area of the heat-dissipating part 133 making contact with the medium 200 will be explained with reference to FIGS. 5A to 6B.

Referring to FIGS. 5B and 6B, concave portions 1331 and convex portions 1332 are formed on the heat-dissipating fins 140 and 170. If the heat-dissipating fins 140 and 170 of FIGS. 5B and 6B, on which the concave portions 1331 and the convex portions 1332 are formed, are compared with the heat-dissipating fins 140 and 170 of FIGS. 5A and 6A, on which the concave portions 1331 and the convex portions 1332 are not formed, the heat-dissipating fins 140 and 170 shown in FIGS. 5B and 6B may have larger specific surface areas. Thus, the contact area with the medium 200 may be increased, and thus, the rate of heat conduction from the heat-dissipating part 133 to the medium 200 may be increased. In this way, the rate of heat conduction from the heat-dissipating part 133 to the medium 200, and the rate of heat conduction from the medium 200 to the outer part 112 of the exterior member 110 may be increased to increase the efficiency of heat dissipation of the LED lighting apparatus 10.

Figure 7A:
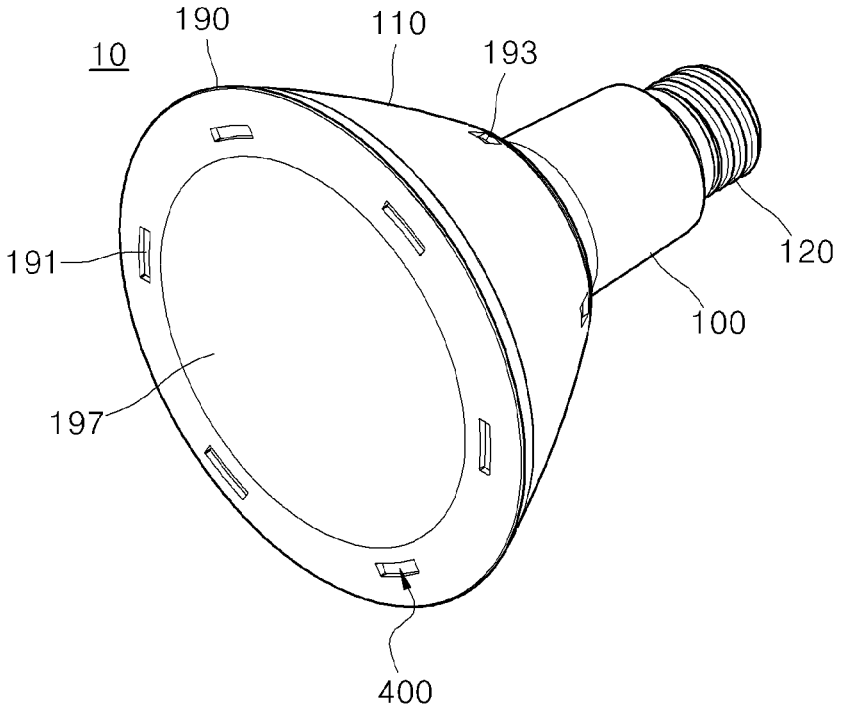
FIG. 7A is a perspective view illustrating an LED lighting apparatus allowing ambient air to pass therethrough according to an embodiment of the disclosure.
Figure 7B:
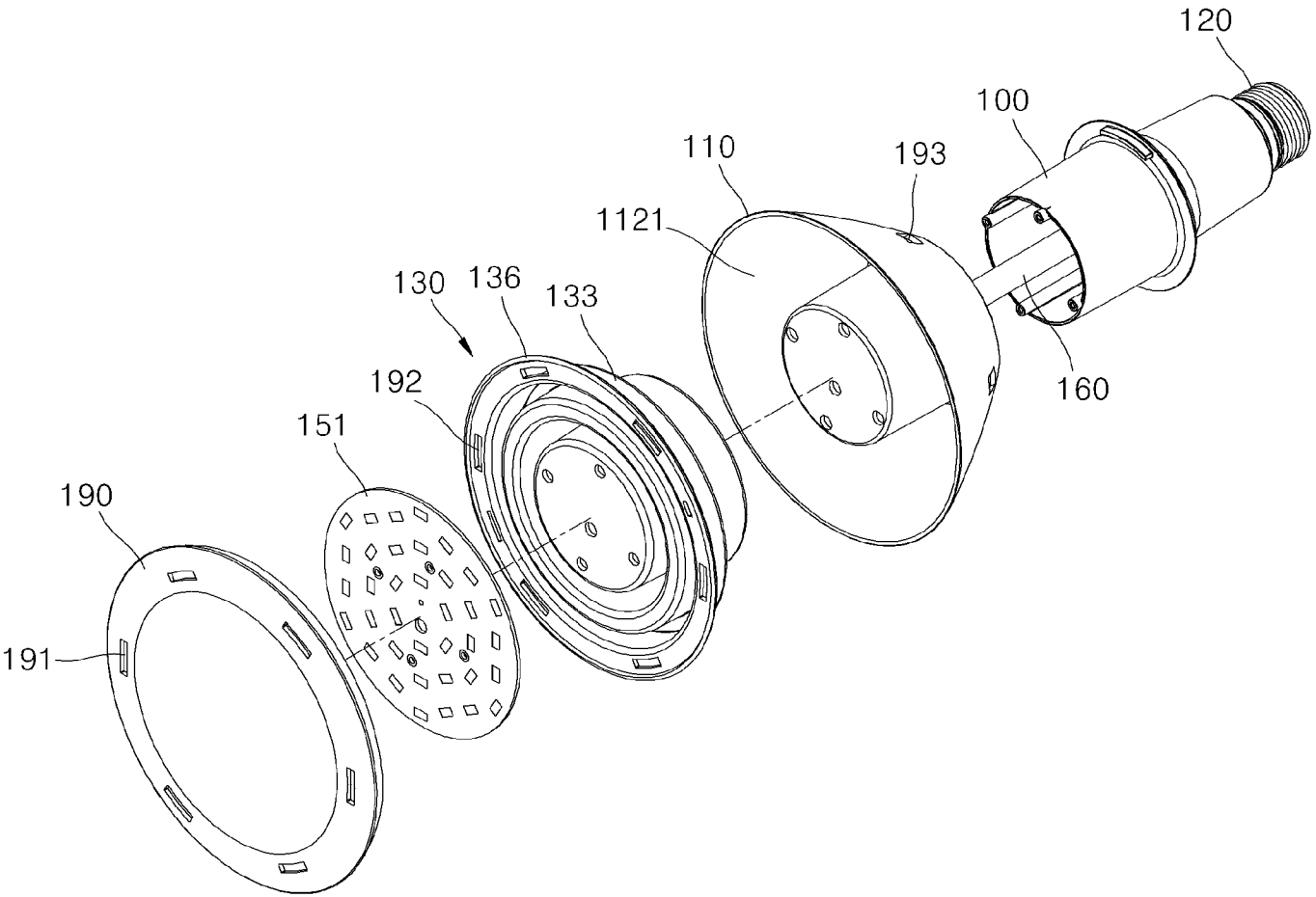
FIG. 7B is an exploded perspective view illustrating the led lighting apparatus allowing ambient air to pass therethrough according to an embodiment of the disclosure.
Figure 7C:
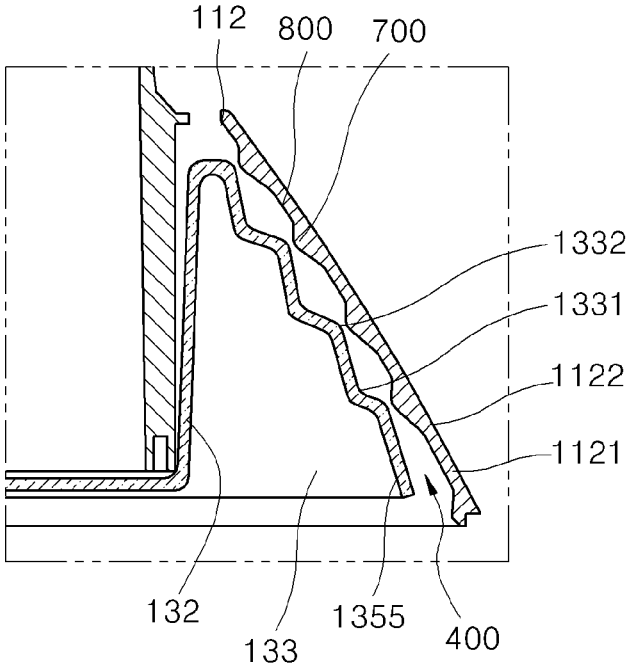
FIG. 7C is a cross-sectional view illustrating modification examples of surfaces of an exterior member and a heat-dissipating member according to an embodiment of the disclosure.

FIGS. 7A and 7B are views illustrating an LED lighting apparatus 10 allowing ambient air to pass therethrough to dissipate heat, according to embodiments of the disclosure. FIG. 7C is a cross-sectional view illustrating a heat-dissipating member and an exterior member having a modified surface structure according to another embodiment of the disclosure.

Referring to FIGS. 1, 7A, and 7B, a plurality of first penetration holes 191 may be formed along the circumference (e.g., the outer circumference) of a cover unit 190, and a plurality of second penetration holes 192 may be formed along an outermost connection portion 136 of a heat-dissipating part 133. In addition, a plurality of third penetration holes 193 may be formed along an upper circumference of an exterior member 110. The cover unit 190 may be coupled to a heat-dissipating member 130 so that the first penetration holes 191 may communicate with the second penetration holes 192, and thus ambient air 400 introduced into the LED lighting apparatus 10 through the first penetration holes 191 may flow through the second penetration holes 192. After passing through the second penetration holes 192, the ambient air 400 flows in a space formed between the heat-dissipating part 133 and a first surface 1121 of the exterior member 110, and then the ambient air 400 flows to the outside of the LED lighting apparatus 10 through the third penetration holes 193 formed in an upper side of the exterior member 110. That is, even after the LED lighting apparatus 10 is assembled, ambient air 400 may flow into the LED lighting apparatus 10 and may dissipate heat while flowing rapidly in a space formed between the heat-dissipating member 130 and the exterior member 110.

Here, the "upper side" of the exterior member 110 may refer to the side of the exterior member 110 which is closest to the socket 120, while the opposite "lower side" of the exterior member 110 may refer to the side of the exterior member 110 which is closest to the cover unit 190. The plurality of first penetration holes 191 may be formed along the circumference (e.g., the outer circumference) of the cover unit 190 at regular or irregular intervals, and may be any shape (for example, rectangular, square, circular, triangular, or any polygonal or geometric shape). The plurality of first penetration holes 191 may all be the same shape or have different shapes. The plurality of second penetration holes 192 may be formed along an outermost connection portion 136 of the heat-dissipating part 133 at positions which correspond to or align with the positions of the plurality of first penetration holes 191. The plurality of second penetration holes 192 may be the same shape or different shape of the corresponding first penetration holes 191. The plurality of second penetration holes 192 may all have the same shape as one another or have different shapes. The plurality of third penetration holes 193 may be formed along an upper circumference of an exterior member 110 and may be the same, less, or greater in number than the number of first penetration holes 191 and/or second penetration holes 192. The plurality of third penetration holes 193 may be the same shape or different shape of the first penetration holes 191 and/or second penetration holes. The plurality of third penetration holes 193 may all have the same shape as one another or have different shapes.

For example, heat may be transferred from the heat-dissipating member 130 to ambient air 400 by thermal conduction. Therefore, as the surface area of the heat-dissipating member 130 is increased, the effect of heat dissipation may be increased. Hereinafter, a method of increasing the surface area of the heat-dissipating part 130 making contact with ambient air 400 will be explained with reference to FIG. 7C.

Referring to FIG. 7C, concave portions 1331 and convex portions 1332 are repeatedly formed on an outermost peripheral portion 1355 of the heat-dissipating part 133, and concave portions 800 and convex portions 700 are repeatedly formed on the first surface 1121 of the exterior member 110. As described above, owing to the concave portions 1331 and convex portions 1332 repeatedly formed on the outermost peripheral portion 1355, and the concave portions 800 and the convex portions 700 repeatedly formed on the first surface 1121 of the exterior member 110, the outermost peripheral portion 1355 may have a large specific surface area, and thus, the contact area between the outermost peripheral portion 1355 and ambient air 400 may be increased. Therefore, the rate of heat conduction from the heat-dissipating part 133 to ambient air 400 may be increased, and thus, the efficiency of heat dissipation of the LED lighting apparatus 10 may be increased.

It should be understood that the exemplary embodiments described herein should be considered in a descriptive sense only and not for purposes of limitation. Thus, the scope and spirit of the disclosure are defined not by the descriptions of the embodiments but by the appended claims.

As described above, an LED lighting apparatus may include a heat-dissipating member which is disposed entirely within an exterior member, such that the LED lighting apparatus has an improved heat dissipation efficiency while not exposing the heat-dissipating member to the outside. Therefore, the LED lighting apparatus may have an increased degree of design freedom and may be dustproof and waterproof. By modifying one or more surfaces of an outer part of the exterior member, an improved heat dissipation efficiency may be obtained. Additionally, or alternatively, by modifying one or more surfaces of the heat-dissipating member, an improved heat dissipation efficiency may be obtained.

According to the disclosure herein (including subject matter disclosed in the claims), an element referred to with the definite article or a demonstrative pronoun may be construed as the element or the elements even though it has a singular form. In addition, if a range is mentioned in the description of an embodiment, it may be construed that individual values included within the ranges are mentioned in the descriptions of embodiments, unless otherwise mentioned. Furthermore, in the descriptions of the embodiments of the disclosure, if operations of a method are mentioned, the operations may be performed in an alternate order unless otherwise specified. That is, operations are not limited to the order in which the operations are described. According to the disclosure herein, examples or exemplary terms (for example, "such as" and "etc.") are used for the purpose of description, and thus the scope and spirit of the disclosure are not limited to the examples or exemplary terms unless limited by the claims. Furthermore, it will be understood by those of ordinary skill in the art that various changes in form and details may be made to the embodiments without departing from the spirit and scope of the disclosure as defined by the following claims.

What is claimed is:

1. An LED (light-emitting diode) lighting apparatus, comprising:

an LED board on which an LED module is disposed;

a heat-dissipating member comprising a mount on which the LED board is disposed, a core connected to the mount, and a heat-dissipating part;

a plurality of concave and convex portions repeatedly arranged around the core, spaced apart from one another in a radial direction of the core and elongated in a lengthwise axial direction of the core;

an exterior member comprising a main body inserted into the core and an outer part extending from an upper edge of the main body to accommodate the plurality of concave and convex portions therein, a side of the outer part having an opening; and a cover unit coupled to the side of the outer part of the exterior member to seal the opening, wherein the heat-dissipating member is provided to be airtight within the exterior member so as to prevent the heat-dissipating member from being exposed to ambient air.

2. The LED lighting apparatus of claim 1, wherein the outer part comprises:

a first surface facing the plurality of concave and convex portions; and a second surface facing an outer side, wherein concave and convex portions are repeatedly formed on the first surface of the outer part.

3. The LED lighting apparatus of claim 1, wherein the outer part comprises:

a first surface facing the plurality of concave and convex portions; and a second surface facing an outer side, wherein bosses are repeatedly formed on the first surface of the outer part.

4. The LED lighting apparatus of claim 1, wherein the plurality of concave and convex portions comprise a first peripheral portion, a second peripheral portion, and a connection portion connecting the first and second peripheral portions, the first and second peripheral portions extend in a circumferential direction of the core, and concave and convex portions are repeatedly formed on at least one surface of the first and second peripheral portions.

5. The LED lighting apparatus of claim 1, further comprising a medium disposed between the heat-dissipating member and the exterior member, the medium having a greater conductivity than that of air.

6. The LED lighting apparatus of claim 1, wherein the heat-dissipating member and the exterior member are formed of one of aluminum, copper, and tungsten.

7. An LED lighting apparatus comprising:

an LED board on which an LED module is disposed;

a heat-dissipating member comprising a mount on which the LED board is disposed, a core connected to the mount, and a plurality of heat-dissipating fins extending from the core, the heat-dissipating fins being spaced apart from one another;

an exterior member comprising a main body inserted into the core and an outer part extending from an upper edge of the main body to accommodate the heat-dissipating fins therein, a side of the outer part having an opening;

a cover unit coupled to the side of the outer part of the exterior member to seal the opening of the side of the outer part; and a medium disposed in a sealed space provided between the heat-dissipating member and the exterior member, the medium having a greater conductivity than that of air.

8. The LED lighting apparatus of claim 7, wherein the outer part comprises:

a first surface facing the heat-dissipating fins; and a second surface facing an outer side, wherein concave and convex portions are repeatedly formed on the first surface of the outer part.

9. The LED lighting apparatus of claim 7, wherein the outer part comprises:

a first surface facing the heat-dissipating fins; and a second surface facing an outer side, wherein bosses are repeatedly formed on the first surface of the outer part.

10. The LED lighting apparatus of claim 7, wherein each of the heat-dissipating fins comprises a first surface and a second surface opposite to the first surface, and concave and convex portions are repeatedly formed on at least one of the first and second surfaces.

11. The LED lighting apparatus of claim 7, wherein the plurality of heat-dissipating fins are ring-shaped, extend in a circumferential direction from the core, and are spaced apart from one another in a lengthwise direction of the core.

12. The LED lighting apparatus of claim 11, wherein each of the heat-dissipating fins comprises a first surface and a second surface opposite to the first surface, and concave and convex portions are repeatedly formed on at least one of the first and second surfaces.

13. The LED lighting apparatus of claim 7, wherein the plurality of heat-dissipating fins extend in a lengthwise direction from the core, and are spaced apart from one another in a circumferential direction of the core.

14. The LED lighting apparatus of claim 13, wherein the heat-dissipating fins have a rectangular plate shape.

15. The LED lighting apparatus of claim 13, wherein each of the heat-dissipating fins comprises a first surface and a second surface opposite to the first surface, and concave and convex portions are repeatedly formed on at least one of the first and second surfaces.

16. The LED lighting apparatus of claim 7, wherein the plurality of heat-dissipating fins are ring or disc shaped, the plurality of heat-dissipating fins which are ring or disc shaped are spaced apart from one another in an axial direction with respect to the core, and the plurality of heat-dissipating fins which are ring or disc shaped each have different lengths in a radial direction with respect to the core.

17. An LED lighting apparatus, comprising:

an LED board on which an LED module is disposed;

a heat-dissipating member comprising a mount on which the LED board is disposed, a core connected to the mount, and a heat-dissipating part extending from an upper circumference of the core;

an exterior member comprising a cylindrical main body inserted into the core and an outer part extending from an upper edge of the main body to accommodate the heat-dissipating part therein, a side of the outer part being opened; and a cover unit disposed at a lower side of the exterior member to cover the LED module, wherein a plurality of first penetration holes are arranged along a circumference of the cover unit, a plurality of second penetration holes are arranged along an outermost portion of the heat-dissipating part, a plurality of third penetration holes are arranged along an upper circumference of the exterior member, the cover unit and the heat-dissipating member are coupled together such that the first penetration holes communicate with the second penetration holes, and ambient air introduced through the first penetration holes flows through the second penetration holes into a space formed between a peripheral portion of the heat-dissipating member and a first surface of the exterior member, and then is discharged through the third penetration holes, wherein concave and convex portions are repeatedly formed in a lengthwise direction of the heat-dissipating part, concave and convex portions are repeatedly formed on an inner surface of the outer part facing the heat-dissipating member, and convex portions formed in the lengthwise direction of the heat-dissipating part correspond to convex portions formed on the inner surface of the outer part.

* * * * *